US011807943B2

(12) United States Patent
Urita et al.

(10) Patent No.: US 11,807,943 B2
(45) Date of Patent: Nov. 7, 2023

(54) ALUMINUM ALLOY FASTENING MEMBER AND METHOD FOR PRODUCING ALUMINUM ALLOY FASTENING MEMBER

(71) Applicant: YKK CORPORATION, Tokyo (JP)

(72) Inventors: Yuki Urita, Toyama (JP); Atsushi Ogihara, Toyama (JP); Shigeru Tsuchida, Toyama (JP); Chikako Hiromi, Toyama (JP); Ryota Ara, Toyama (JP); Sohei Nagasawa, Kanagawa (JP); Mitsuomi Katori, Kanagawa (JP); Misako Hosaka, Kanagawa (JP)

(73) Assignee: YKK Corporation, Tokyo (JP)

( * ) Notice: Subject to any disclaimer, the term of this patent is extended or adjusted under 35 U.S.C. 154(b) by 699 days.

(21) Appl. No.: 16/843,738

(22) Filed: Apr. 8, 2020

(65) Prior Publication Data

US 2020/0399762 A1 Dec. 24, 2020

(30) Foreign Application Priority Data

Jun. 21, 2019 (JP) ..... 2019-115616

(51) Int. Cl.

| | |
|---|---|
| ***C23C 22/48*** | (2006.01) |
| ***C22F 1/05*** | (2006.01) |
| ***C22C 21/02*** | (2006.01) |
| ***C23C 22/66*** | (2006.01) |
| ***C23C 22/73*** | (2006.01) |
| ***A44B 19/06*** | (2006.01) |
| ***C23C 22/56*** | (2006.01) |
| ***C22C 21/08*** | (2006.01) |

(Continued)

(52) U.S. Cl.

CPC ..... *C23C 22/66* (2013.01); *A44B 19/06* (2013.01); *C22C 21/08* (2013.01); *C23C 22/56* (2013.01); *C23C 22/73* (2013.01); *A44B 19/36* (2013.01)

(58) Field of Classification Search

CPC ..... C22F 1/04–057

See application file for complete search history.

(56) References Cited

U.S. PATENT DOCUMENTS 2,933,422 A * 4/1960 Mason ..... C23C 22/40 106/287.18

3,032,435 A 5/1962 Michel (Continued)

FOREIGN PATENT DOCUMENTS

CH 586757 A5 4/1977

CN 101400825 A 4/2009

(Continued)

OTHER PUBLICATIONS

Office action dated Nov. 30, 2021 from counterpart DE App No. 10 2020 003 684.8, 17 pgs.

(Continued)

*Primary Examiner* — Lois L Zheng

(74) *Attorney, Agent, or Firm* — Procopio, Cory, Hargreaves & Savitch LLP

(57) ABSTRACT

Provided is an aluminum alloy fastening member including a chemical conversion coating having a novel composition as a colored coating, and a method for producing the (Continued)

aluminum alloy fastening member. The aluminum alloy fastening member includes a chemical conversion coating containing tellurium as a component element.

6 Claims, 2 Drawing Sheets

(51) Int. Cl.

| | |
|---|---|
| *C22F 1/04* | (2006.01) |
| *C22F 1/043* | (2006.01) |
| *C22F 1/047* | (2006.01) |
| *C22C 21/06* | (2006.01) |
| *A44B 19/36* | (2006.01) |

(56) References Cited

U.S. PATENT DOCUMENTS

| | | | | |
|---|---|---|---|---|
| 4,427,458 | A | 1/1984 | Hasegawa et al. | |
| 5,089,349 | A | 2/1992 | Kaiser | |
| 2003/0230215 | A1* | 12/2003 | Matzdorf ..... | C09D 5/084 106/14.44 |

FOREIGN PATENT DOCUMENTS

| | | | |
|---|---|---|---|
| EP | 1992718 | A1 | 11/2008 |
| JP | S57-093003 | A | 6/1982 |
| JP | S57-0198265 | A | 12/1982 |
| JP | S60-110895 | A | 6/1985 |
| JP | H03-094074 | A | 4/1991 |
| JP | H05-295561 | A | 11/1993 |
| JP | 2008144225 | A | 6/2008 |
| JP | 2010-090407 | A | 4/2010 |
| JP | 2010-090409 | A | 4/2010 |

OTHER PUBLICATIONS

First Examination Report for related IN App No. 202014015126 dated Jul. 12, 2021, 5 pgs.

Office Action received in Japanese Application No. 2019-115616, dated Jan. 4, 2023, in 9 pages, with English translation.

Office Action received in Japanese Application No. 2019-115616, dated May 23, 2023, in 8 pages, with English translation.

* cited by examiner

ALUMINUM ALLOY FASTENING MEMBER AND METHOD FOR PRODUCING ALUMINUM ALLOY FASTENING MEMBER

CROSS-REFERENCE TO RELATED APPLICATIONS

This application claims priority to Japanese Patent Application No. 2019-115616 filed on Jun. 21, 2019, the contents of which are incorporated herein by reference.

FIELD OF THE INVENTION

The present invention relates to an aluminum alloy fastening member and a method for producing an aluminum alloy fastening member.

BACKGROUND OF THE INVENTION

Conventionally, in coloring of an aluminum alloy, it is known to adsorb a dye onto an anodized coating or an anodic oxidation coating.

For example, Patent Literature 1 discloses a method for electrolytically coloring an aluminum alloy, comprising providing a coating structure capable of electrolytic coloring, from a colored coating formed on a base surface of the aluminum alloy due to electrolytic coloring or spontaneous coloring; and then carrying out electrolytic coloring to superimpose the colors to obtain a coating having a new color tone. It also discloses that according to such a structure, it is possible to obtain various color tones including various intermediate colors, which would not otherwise be obtained by the conventional electrolytic coloring method.

CITATION LIST

Patent Literatures

Patent Literature 1: Japanese Patent Application Publication No. S60-110895 A

SUMMARY OF THE INVENTION

In the technique of coloring the aluminum alloy as disclosed in Patent Literature 1, the colored chemical conversion coating is formed in an organic acid bath such as malonic acid, maleic acid, oxalic acid, and sulfosalicylic acid, or in a bath obtained by adding a metal salt such as Sn, Mn, Co, and Cu to sulfuric acid. It also discloses that nickel sulfate is specifically used as the metal salt in Examples.

Conventionally, the surface of the aluminum alloy is thus colored by forming the chemical conversion coating using various metal salts. However, there is room for further development of a surface coloring technique for an aluminum alloy.

An object of the present invention is to provide an aluminum alloy fastening member including a chemical conversion coating having a novel composition as a colored coating, and a method for producing the aluminum alloy fastening member.

As results of intensive studies to solve the above problems, the present inventors have found that formation of a chemical conversion coating containing tellurium as a component element can provide an aluminum alloy fastening member including a chemical conversion coating having a novel composition as a colored coating.

In one aspect, the present invention completed on the basis of the above findings is an aluminum alloy fastening member comprising a chemical conversion coating, the chemical conversion coating containing tellurium as a component element.

In an embodiment of the aluminum alloy fastening member according to the present invention, the chemical conversion coating of the aluminum alloy fastening member satisfies color tone ranges of $-5 \leq a^* \leq 10$; $-3 \leq b^* \leq 18$; and $0 \leq L^* \leq 75$, in a CIELAB color space as defined in JIS Z 8781-4 (2013).

In another embodiment of the aluminum alloy fastening member according to the present invention, the chemical conversion coating of the aluminum alloy fastening member further presents a gray color that satisfies color tone ranges of $-5 \leq a^* \leq 8$; $-3 \leq b^* \leq 10$; and $40 \leq L^* \leq 75$ in a CIELAB color space as defined in JIS Z 8781-4 (2013).

In still another embodiment of the aluminum alloy fastening member according to the present invention, the chemical conversion coating has an average thickness of from 0.01 to 1.00 μm.

In still another embodiment of the aluminum alloy fastening member according to the present invention, the chemical conversion coating comprises 10% by mass or more of tellurium and/or a tellurium compound.

In still another embodiment of the aluminum alloy fastening member according to the present invention, the aluminum alloy has a composition represented by a general formula: $Al_aSi_bMg_c$, with each of a, b, c being % by mass; the symbol a being the balance; $0.1 \leq b \leq 1.5$; $0.2 \leq c \leq 5.6$; and which may contain unavoidable impurities.

In still another embodiment of the aluminum alloy fastening member according to the present invention, the aluminum alloy fastening member is an element for slide fasteners, a slider for slide fasteners, a stopper for slide fasteners, or a button.

In another aspect, the present invention is a method for producing the aluminum alloy fastening member according to one embodiment of the present invention, comprising a step of forming a chemical conversion coating containing tellurium as a component element by immersing an aluminum alloy fastening member in a metal surface treatment solution containing tellurium or a tellurium compound or a salt thereof.

In one embodiment of the method for producing the aluminum alloy fastening member according to the present invention, the tellurium or the tellurium compound or the salt thereof is tellurium monoxide, tellurium dioxide, tellurium trioxide, tellurous acid, telluric acid, tellurium tetrachloride, dimethyl telluride, or a salt thereof, or a combination thereof.

According to the present invention, it is possible to provide an aluminum alloy fastening member including a chemical conversion coating having a novel composition as a colored coating, and a method for producing the aluminum alloy fastening member.

DETAILED DESCRIPTION OF THE INVENTION

Figure 1:
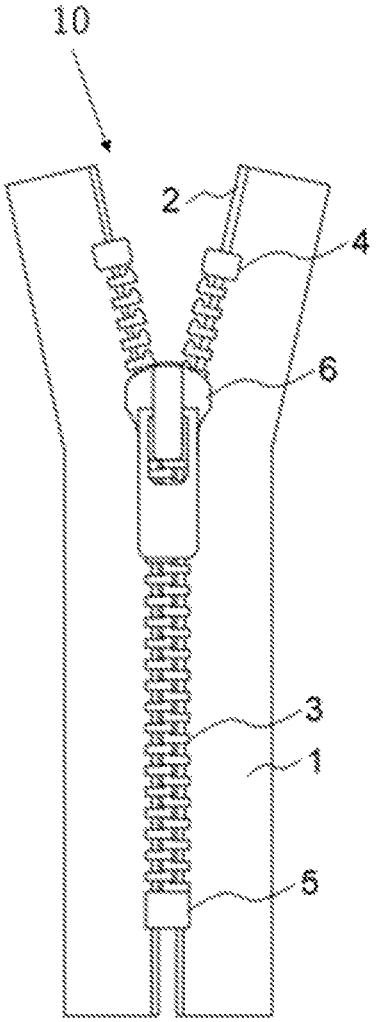
FIG. 1 is a schematic external view of a slide fastener according to an embodiment of the present invention.

Hereinafter, embodiments of an aluminum alloy fastening member and a method for the aluminum alloy fastening member according to the present invention will be described with reference to the drawings. However, the present invention is not limited to the embodiments, and various changes, modifications, and improvements may be added without departing from the scope of the present invention, based on knowledge of those skilled in the art.

[Aluminum Alloy Fastening Member]

An aluminum alloy fastening member according to an embodiment of the present invention includes a chemical conversion coating containing tellurium as a component element on a surface of the fastening member formed of an aluminum alloy. The chemical conversion coating containing the tellurium as the component element can form a colored coating, resulting in color on the surface of the fastening member formed of the aluminum alloy.

<Aluminum Alloy>

Examples of the aluminum alloy that is a material for the fastening member include an Al—Si—Mg alloy, an Al—Cu—Mg alloy, an Al—Mn alloy, an Al—Si alloy, an Al—Mg alloy, and an Al—Zn—Mg alloy. In the aluminum alloy fastening member according to an embodiment of the present invention, it is particularly preferable to use an Al—Si—Mg alloy as the aluminum alloy, and it is more preferable to use an Al—Mg alloy. More particularly, the aluminum alloy preferably has a composition represented by the general formula: $Al_aSi_bMg_c$, with each of a, b, c being % by mass; the symbol a being the balance; $0.1 \leq b \leq 1.5$; $0.2 \leq c \leq 5.6$; and which may contain unavoidable impurities.

Si has an effect of forming an extremely small intermetallic compound with Mg by dissolving Si in an Al matrix and then carrying out an aging heat treatment, resulting in improvement of mechanical properties (strength and hardness) of the alloy. When the composition ratio of Si is 0.1% by mass or more, the strength and hardness of the aluminum alloy are preferably improved. When the composition ratio of Si is 1.5% by mass or less, coarse precipitation or crystallization of Si itself can be suppressed, elongation in plastic deformation can increases, resulting in improved workability. The composition ratio (b) of Si is more preferably 0.25 (% by mass) s b s 0.9 (% by mass), that is, 0.25% by mass or more and 0.9% by mass or less, and even more preferably 0.25% by mass or more and less than 0.35% by mass.

Mg has an effect of forming an extremely small intermetallic compound with Si by a heat treatment, resulting in improved mechanical properties (strength and hardness) of the alloy. Further, it has an effect of improving mechanical properties (strength and hardness) of the alloy by forming a solid solution in Al as a matrix. The composition ratio (c) of Mg is preferably 0.8 (% by mass)$\leq c \leq$5.6 (% by mass), that is, 0.8% by mass or more and 5.6% by mass or less, and more preferably 4.5% by mass or more and 5.6% by mass or less. When an appropriate amount of Mg is added, softening in a heating step (washing, drying, or the like) after cold working can be prevented. In particular, any movement of a dislocation introduced by the cold rolling is prevented by atoms (Mg) precipitated in the Al matrix by the aging heat treatment, so that a decrease in strength due to the heat treatment can be suppressed.

The unavoidable impurities refer to acceptable impurities, because although they are present in raw materials or unavoidably mixed in production steps and are essentially unnecessary, they are present in a minor amount and do not affect properties. In the present invention, the content of each of impurity elements acceptable as the unavoidable impurities is generally 0.1% by mass or less, and preferably 0.05% by mass or less.

<Chemical Conversion Coating>

Tellurium contained as a component element of the chemical conversion coating on the aluminum alloy fastening member according to an embodiment of the present invention may be contained as simple tellurium (Te) and/or a tellurium compound. The tellurium compound may be tellurium oxide. The content of tellurium and/or the tellurium compound in the chemical conversion coating can be appropriately adjusted depending on a desired color tone. In general, as the content of tellurium and/or tellurium compound in the chemical conversion coating is higher, the color tone will be darker, and as the content is lower, the color tone will be lighter. The chemical conversion coating on the aluminum alloy fastening member according to an embodiment of the present invention may contain tellurium and/or the tellurium compound in an amount of 10% by mass or more, or 10% by mass or more and 100% by mass or less.

In the aluminum alloy fastening member according to the embodiment of the present invention, the chemical conversion coating preferably satisfies color tone ranges of $-5 \leq a^* \leq 10$; $-3 \leq b^* \leq 18$; and $0 \leq L^* \leq 75$ in a CIELAB color space as defined in JIS Z 8781-4 (2013). It should be noted that the symbol a* is a value indicating a magenta-green color tone (plus (+) is magentaish, and minus (−) is greenish), and the symbol b* is a value indicating a yellow-blue color tone (plus (+) is yellowish, and minus (−) is blueish). The symbol L* shows lightness, and as its value is higher, the glossiness will be higher. A wide range of colors can be obtained by forming a chemical conversion coating that satisfies the above color tone ranges on the surface of the fastening member made of the aluminum alloy.

In the aluminum alloy fastening member according to an embodiment of the present invention, the chemical conversion coating preferably presents a gray color that satisfies color tone ranges of $-5 \leq a^* \leq 8$; $-3 \leq b^* \leq 10$; and $40 \leq L^* \leq 75$ in a CIELAB color space as defined in JIS Z 8781-4 (2013). The symbol L* is preferably in a luminous intensity range of $45 \leq L^* \leq 73$.

The chemical conversion coating on the aluminum alloy fastening member according to an embodiment of the present invention has an average thickness of from 0.01 to 1.00 μm in the gray-colored region that satisfies the color tone ranges of $-5 \leq a^* \leq 8$; $-3 \leq b^* \leq 10$; and $40 \leq L^* \leq 75$ in the CIELAB color space as defined in JIS Z 8781-4 (2013). The average thickness of the chemical conversion coating can be evaluated by the following method. First, the cross section of the gray-colored region in the chemical conversion coating is polished by a conventional method, and then observed with an electron microscope such as an SEM to select arbitrary five points at equal intervals (for example, an interval of 1 μm from each other). The thicknesses of the chemical conversion coating at the five points are then measured, and an average value of them is calculated to determine it to be the average thickness in the gray-colored region. If the average thickness of the chemical conversion coating is less than 0.01 μm, the color of the base material will appear on the surface because of the lower thickness, so that the silver color is presented. When the average thickness of the chemical conversion coating is 0.01 μm or more, the desired gray color can be more reliably developed on the surface of the aluminum alloy fastening member. When the average thickness of the chemical conversion coating is 1.00

μm or less, the costs required for forming the chemical conversion coating can be suppressed while more reliably developing the desired gray color on the surface of the aluminum alloy fastening member. If the average thickness of the chemical conversion coating is higher than 1.00 μm, the coating presents a black color because the coating is thicker. Further, the adhesion to aluminum is deteriorated, and the coating is peeled off. The average thickness of the chemical conversion coating is more preferably from 0.1 to 0.5 μm.

The aluminum alloy fastening member according to an embodiment of the present invention may be an element for slide fasteners, a slider for slide fasteners, a stopper for slide fasteners, or a button.

<Element for Slide Fasteners, Slider for Slide Fasteners, Stopper for Slide Fasteners, or Button>

FIG. 1 is a schematic external view of a slide fastener 10 according to an embodiment of the present invention. The slide fastener 10 as shown in FIG. 1 merely illustrates one embodiment of the present invention, and is not limited to this structure. The slide fastener 10 includes: a pair of fastener tapes 1 each having a core portion 2 formed on one side end side; elements 3 (elements for slide fasteners) which are each fixed by means of caulking (attached) to the core portion 2 of each fastener tape 1 at predetermined intervals; upper stoppers 4 (upper stoppers for slide fasteners) and a lower stopper 5 (a lower stopper for slide fasteners) fixed by means of caulking to the core portions 2 of the fastener tapes 1 at upper and lower ends of the elements 3, respectively; a slider 6 (a slider for slide fasteners) provided between a pair of opposing rows of the elements 3 and slidable in a up and down direction for engaging and disengaging the elements 3. It should be noted that a member in which the elements 3 are attached to the core portion 2 of one fastener tape 1 is referred to as a slide fastener stringer, and a member in which the elements 3 attached to the core portions 2 of the pair of fastener tapes 1 have been engaged is referred to as a slide fastener chain. By thus using the aluminum alloy fastening members according to an embodiment of the present invention as the elements 3, the slider 6, the upper stoppers 4, and the lower stopper 5 for the slide fastener 10, the elements, the slider, and the stoppers for the slide fastener can be colored as desired, and for example, a gray color can be applied to produce a slide fastener having improved aesthetic appearance.

Figure 2:
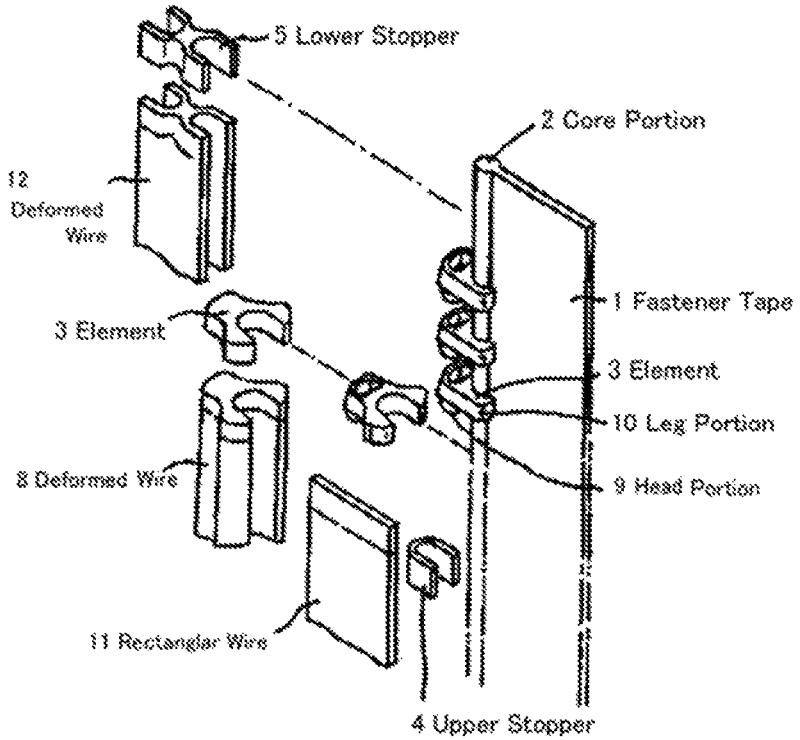
FIG. 2 is a schematic view showing a method for producing elements, an upper stopper and a lower stopper of for the slide fastener as shown in FIG. 1, and a method of attaching them to a core portion of a fastener tape.

FIG. 2 is a schematic view showing a method for producing the elements 3, the upper stoppers 4 and the lower stopper 5 for the slide fastener as shown in FIG. 1 and how to attach these members to the core portion 2 of the fastener tape 1. As shown in FIG. 2, the elements 3 are formed by cutting a metallic deformed wire 8 having a substantially Y-shaped cross section into pieces each having predetermined dimensions, and pressing each piece to form a head portion 9, and then attached to the core portion 2 by caulking both leg portions 10 onto the core portion 2 of the fastener tape 1. The upper stopper 4 is formed by cutting a metallic rectangular wire 11 having a rectangular cross section into pieces each having predetermined dimensions, and bending the pieces to form a substantially C-shaped cross section, and then attached to the core portion 2 by caulking each piece onto the core portion 2 of the fastener tape 1. The lower stopper 5 is formed by cutting a metallic deformed wire 12 having a substantially X-shaped cross section 12 into pieces each having predetermined dimensions, and then attached to the core portion 2 by caulking each piece onto the core portion 2 of the fastener tape 1. In addition, FIG. 2 shows that the elements 3, the upper stopper 4 and the lower stopper 5 are simultaneously attached to the fastener tape 1. However, actually, the elements 3 are first attached intermittently to certain regions of the fastener tape 1 to form a fastener chain, and opposing element rows of a pair of fastener chains are engaged to each other to produce a fastener chain. The predetermined upper or lower stopper 4,5 is then attached in a region having no element 3 in the fastener chain.

The use of the aluminum alloy fastening member according to an embodiment of the present invention is not limited to the slide fastener, and it can also be applied to a snap fastener and other members for metal fasteners. Further, the aluminum alloy fastening member according to an embodiment of the present invention may be a button. The form of the button is not particularly limited, and it can be applied to a known button.

[Method for Producing Aluminum Alloy Fastening Member]

Next, a method for producing the aluminum alloy fastening member according to an embodiment of the present invention will be described in detail. First, a bath is prepared that contains a metal surface treatment solution including tellurium, a tellurium compound, or a salt thereof. The aluminum alloy fastening member to be treated is then immersed in the metal surface treatment solution while controlling a temperature of the metal surface treatment solution in the bath. After a certain period of time, the metal to be treated is pulled up from the bath, so that a chemical conversion coating which is a colored coating is formed on the surface, and an aluminum alloy fastening member developed into a desired color tone is obtained. Thus, according to the method for producing the aluminum alloy fastening member according to the embodiment of the present invention, only by immersing the aluminum alloy fastening member to be treated in the metal surface treatment solution containing tellurium, the tellurium compound, or the salt thereof, a desired color tone can be obtained. Therefore, when coloring the surface of the aluminum alloy fastening member, it is not necessary to form an oxide film on the surface of the aluminum alloy fastening member, and it is not necessary to perform coloring by electrolysis, thereby improving the treatment efficiency.

Further, in the method for producing the aluminum alloy fastening member according to the embodiment of the present invention, the surface of the aluminum alloy fastening member may be colored, for example by bringing the surface treatment solution into contact with the surface, for example in a spraying step of the metal surface treatment solution, in addition to the immersion of the aluminum alloy fastening member to be treated in the metal surface treatment solution.

<Metal Surface Treatment Solution>

(Tellurium or Tellurium Compound or Salt Thereof)

Tellurium or the tellurium compound or the salt thereof in the metal surface treatment solution is preferably tellurium monoxide, tellurium dioxide, tellurium trioxide, telluric acid, telluric acid, tellurium tetrachloride, dimethyl telluride, or a salt thereof, or a combination thereof. The salts of tellurium monoxide, tellurium dioxide, tellurium trioxide, tellurous acid, telluric acid, tellurium tetrachloride, and dimethyl telluride that can be used include metal salts or ammonium salts of them.

The total content of tellurium or the tellurium compound or the salt thereof in the metal surface treatment solution depends on the type of aluminum alloy fastening member to be treated, and on color tones to be developed, and, for example, the total content of tellurium or the tellurium compound or the salt thereof can be from 0.5 to 100 g/L. Basically, as the total content of tellurium, the tellurium compound or the salt thereof is lower, the surface of the aluminum alloy fastening member can be colored into a lighter color tone. Further, as the total content of tellurium, the tellurium compound or the salt thereof is higher, the surface of the aluminum alloy fastening member can be colored into a darker color tone. The total content of tellurium, the tellurium compound or the salt thereof is more preferably from 1 to 50 g/L, and even more preferably from 2 to 20 g/L.

The metal surface treatment solution may contain an inorganic acid or its salt, an organic sulfur compound or its salt, a carboxylic acid or a hydroxycarboxylic acid or their salts, an oxo acid or its salt, as described below. However, for the metal surface treatment solution that does not contain these components, the surface of the aluminum alloy can be colored into a grayish tone having more improved appearance.

(Inorganic Acid or its Salt)

The metal surface treatment solution may further contain an inorganic acid or its salt. Even if the metal surface treatment solution contains the inorganic acid or its salt, the surface of the aluminum alloy fastening member to be treated can be colored into a desired color tone with good treatment efficiency.

The inorganic acid or its salt is preferably sulfuric acid, nitric acid, hydrochloric acid, phosphoric acid, or salts thereof, or combinations thereof. The salts of sulfuric acid, nitric acid, hydrochloric acid and phosphoric acid that can be used include metal salts or ammonium salts of these acids.

The total content of the inorganic acid or its salt in the metal surface treatment solution can be from 1 to 200 g/L Basically, as the total content of the inorganic acid or its salt is lower, the surface of the aluminum alloy fastening member can be colored into a lighter color tone. Further, as the total content of the inorganic acid or its salt is higher, the metal surface can be colored into a deeper color tone. The total content of the inorganic acid or its salt is more preferably from 10 to 150 g/L, and even more preferably from 70 to 120 g/L.

(Organic Sulfur Compound or its Salt)

The metal surface treatment solution may further contain an organic sulfur compound or its salt Even if the metal surface treatment solution contains the organic sulfur compound or its salt, the surface of the aluminum alloy fastening member to be treated can be colored into a desired color tone with good treatment efficiency.

When the organic sulfur compound or its salt may preferably be thiourea, thiourea dioxide, thiodiglycol, dimethylthiourea, thiomalic acid, dithiodiglycolic acid, dimethyl sulfoxide, methanesulfonic acid, p-toluenesulfonic acid, p-phenolsulfonic acid, thiocyanic acid, cysteine, methionine, or salts thereof, or combinations thereof. The salts of thiourea, thiourea dioxide, thiodiglycol, dimethylthiourea, thiomalic acid, dithiodiglycolic acid, dimethylsulfoxide, methanesulfonic acid, p-toluenesulfonic acid, p-phenolsulfonic acid, thiocyanic acid, cysteine, and methionine that can be used include metal salts or ammonium salts of those acids.

The total content of the organic sulfur compound or its salt in the metal surface treatment solution can be from 0.1 to 50 g/L. Basically, as the total content of the organic sulfur compound or its salt is lower, the surface of the aluminum alloy fastening member can be colored into a lighter color tone. Further, as the total content of the organic sulfur compound or its salt is higher, the surface of the aluminum alloy fastening member can be colored into a darker color tone. The total content of the organic sulfur compound or its salt is more preferably from 1 to 30 g/L, and even more preferably from 5 to 15 g/L.

(Carboxylic Acid or Hydroxycarboxylic Acid, or Salt Thereof)

The metal surface treatment solution may further contain a carboxylic acid or a hydroxycarboxylic acid, or a salt thereof. Even if the metal surface treatment solution contains the carboxylic acid or the hydroxycarboxylic acid, or the salt thereof, the surface of the aluminum alloy fastening member to be treated can be colored into a desired color tone with good treatment efficiency.

The carboxylic acid or the hydroxycarboxylic acid, or the salt thereof may preferably be formic acid, acetic acid, propionic acid, lactic acid, malic acid, citric acid, oxalic acid, gluconic acid, malonic acid, succinic acid, benzoic acid, pyruvic acid, glyoxylic acid, nitrilotriacetic acid, ethylenediaminetetraacetic acid, or salts thereof, or combinations thereof. The salts of formic acid, acetic acid, propionic acid, lactic acid, malic acid, citric acid, oxalic acid, gluconic acid, malonic acid, succinic acid, benzoic acid, pyruvic acid, glyoxylic acid, nitrilotriacetic acid, and ethylenediaminetetraacetic acid that can be used include metal salts or ammonium salts of those acids.

The total content of the carboxylic acid or the hydroxycarboxylic acid or the salt thereof in the metal surface treatment solution can be from 0.5 to 100 g/L. Basically, as the total content of the carboxylic acid or the hydroxycarboxylic acid or the salt thereof is lower, the surface of the aluminum alloy fastening member can be colored into a darker color tone. Further, as the total content of the carboxylic acid or the hydroxycarboxylic acid or the salt thereof is higher, the surface of the aluminum alloy fastening member can be colored into a lighter color tone. The total content of the carboxylic acid or the hydroxycarboxylic acid or the salt thereof is more preferably from 1 to 50 g/L, and even more preferably from 10 to 30 g/L.

(Oxo Acid or its Salt)

The metal surface treatment solution may further contain an oxo acid or its salt. Even if the metal surface treatment solution contains the oxo acid or its salt, the surface of the aluminum alloy fastening member to be treated can be colored into a desired color with good treatment efficiency.

The oxo acid or its salt may preferably be perchloric acid, chloric acid, chlorous acid, hypochlorous acid, bromic acid, carbonic acid, boric acid, or salts thereof, or combinations thereof. The salts of perchloric acid, chloric acid, chlorous acid, hypochlorous acid, bromic acid, carbonic acid, and boric acid that can be used include metal salts or ammonium salts of those acids.

The total content of the oxo acid or its salt in the metal surface treatment solution can be from 0.5 to 100 g/L. Basically, as the total content of the oxo acid or its salt is lower, the surface of the aluminum alloy fastening member can be colored into a lighter color tone. Further, as the total content of the oxo acid or its salt is higher, the surface of the aluminum alloy fastening member can be colored into a darker color tone. The total content of the oxo acid or its salt is more preferably from 1 to 50 g/L, and even more preferably from 10 to 30 g/L.

(Aqueous Medium)

The metal surface treatment solution may be a mixture of the various components as described above and an aqueous medium. The aqueous medium refers to a medium containing water as a main component. Examples of the aqueous medium include a medium containing water as a main component and an organic solvent such as an alcohol miscible with water. During the preparation of the metal surface treatment solution according to an embodiment of the present invention, during storage of the metal surface treatment solution, or after coloring of the surface of the aluminum alloy fastening member, the aqueous medium may optionally contain various components that advantageously act to improve any property of the colored surface of the aluminum alloy fastening member, or various components that do not substantially inhibit the effects of the present invention. Specific examples of these components include pH adjusting agents, storage stabilizers and the like.

<Treatment Temperature>

A treatment temperature with the metal surface treatment solution is preferably in a range of from 10 to 80° C., and more preferably in a range of from 10 to 60° C., and even more preferably in a range of from 30 to 60° C. When the treatment temperature is 10° C. or more, a reaction velocity of the surface treatment increases, and when the treatment temperature is 80° C. or less, a decrease in a liquid level of the metal surface treatment solution due to evaporation can be suppressed.

<Treatment Time>

A treatment time with the metal surface treatment solution is preferably in a range of from 10 seconds to 20 minutes, and more preferably in a range of from 30 seconds to 20 minutes, and even more preferably in a range of from 1 minute to 10 minutes. Basically, as the treatment time is shorter, the surface of the aluminum alloy fastening member can be colored into a lighter color tone. Further, as the treatment time is longer, the surface of the aluminum alloy fastening member can be colored into a darker color tone.

<Pre-Treatment>

When carrying out the metal surface treatment, the aluminum alloy fastening member can be previously degreased, activated, or surface-adjusted to improve the appearance, corrosion resistance and reactivity with the metal surface treatment solution of the aluminum alloy fastening member.

<Post-Treatment>

After the metal surface treatment, a post-treatment may be carried out with coating agents containing one or more selected from the group consisting of silicon, a resin and a wax. These coating agents are not particularly limited as long as they do not affect the desired color tone on the surface of the aluminum alloy fastening member, and include coating agents containing resins such as acrylic resins, olefin resins, alkyd resins, urea resins, epoxy resins, melamine resins, fluororesins, polyethylene, polyvinyl chloride, polystyrene, polypropylene, methacrylic resins, phenolic resins, polyester resins, polyurethane, polyamide, and polycarbonate, and silicates, colloidal silica or the like. The concentration of those resins is preferably from 0.01 to 800 g/L, although the appropriate concentration varies depending on the type of resins.

EXAMPLES

Hereinafter, while Examples of the present invention will be described, these Examples are provided for better understanding of the present invention, and are not intended to limit the present invention.

Coloring Test for Aluminum Alloy

Test Example 1

As samples of Test Example 1, each slide fastener chain with attached A5056 aluminum alloy elements having an alloy composition as shown in Test Example 1 of Table 1, as defined in JIS H 4040: 2015, was prepared for each treatment condition, and analyzed for twelve elements in each case. Table 1 shows its average value. The size of each aluminum alloy element on the surface where the fastener tape extended was 4.0 $mm^2$.

The surface of each sample was then degreased and washed with water in this order.

A bath containing a metal surface treatment solution of 5 g/L of sodium tellurite was prepared, and the pH was adjusted to 10. Pure water was used as the aqueous medium of the metal surface treatment solution.

Each sample was then immersed in a state where the metal surface treatment solution in the bath was controlled at 40° C., 50° C., 60° C., 70° C., or 80° C. After immersion for 60 seconds, 120 seconds, 150 seconds, or 180 seconds, each sample was removed.

Subsequently, the surface of each sample was washed with water and then dried.

Test Example 2

As a sample of Test Example 2, a slide fastener chain with attached aluminum alloy elements having an alloy composition as shown in Test Example 2 of Table 1, as disclosed in WO 2016/157337 A1, was prepared, and twelve elements of those elements were analyzed. Table 1 shows its average value. The size of each aluminum alloy element on the surface where the fastener tape extended was 4.0 $mm^2$. A bath containing the same metal surface treatment solution as that of Test Example 1 was then prepared, and the sample was immersed in the bath for 120 seconds while controlling the metal surface treatment solution at 50° C., and then removed.

Subsequently, the surface of the sample was washed with water and then dried.

Test Example 3

As a sample of Test Example 3, a plate member made of A5052 aluminum alloy having the alloy composition as shown in Test Example 3 in Table 1 and defined in JIS H4000: 2014 was prepared and analyzed at arbitrary twelve points. Table 1 shows its average value. A portion of the plate member surface immersed in the metal surface treatment solution had a size: length×width=30 mm×45 mm. A bath containing the same metal surface treatment solution as that of Test Example 1 was then prepared, and the sample was immersed in the bath for 120 seconds while controlling the metal surface treatment solution at 50° C., and then removed.

The surface of the sample was washed with water and then dried.

(Color Tone Evaluation)

For each sample of Test Examples 1 to 3, a*, b*, and L* in the CIELAB color space as defined in JIS Z 8781-4 (2013) were determined for one surface of the element of the slide fastener chain after the treatment, under conditions of 0 to 40° C. and 85% RH using a colorimeter RTC-21 from Ikegami Tsushinki Co., Ltd. As a light source, LED illumination was used.

Also, the appearance of each sample of Test Examples 1 to 3 was visually observed to evaluate what kind of color it looks like. The appearance of each base material of Test Examples 2 and 3 is a silver color similar to that of Test Example 1.

(Evaluation of Average Thickness of Chemical Conversion Coating)

An average thickness of each test sample in a region presenting a gray color that satisfies color tone ranges of $-5 \leq a^* \leq 8$; $-3 \leq b^* \leq 10$; and $40 \leq L^* \leq 75$ in the CIELAB color space defined in JIS Z 8781-4 (2013) was evaluated by the following method. First, the cross section of the chemical conversion coating in the region presenting the gray color was polished by a conventional method, and then observed with a scanning electron microscope (SEM), and arbitrary five points were selected at equal intervals (a distance of 0.1 μm from each other). Subsequently, the thicknesses of the chemical conversion coating at the five points were measured, and its average value was calculated and determined to be the average thickness in the region presenting the gray color.

[Component Evaluation of Chemical Conversion Coating]

For each test sample, the content of tellurium and/or a tellurium compound in the chemical conversion coating was evaluated by the following method. First, each test sample was processed into thin pieces by focused ion beam (FIB) processing, and then subjected to compositional analysis with energy dispersive X-ray spectrometry (EDX); GENESIS from AMETEK Co., Ltd.) of a scanning transmission electron microscope (S-TEM; HD-2300A from Hitachi High-Technologies Corporation; an acceleration current of 200 kV).

Table 1 shows test conditions and evaluation results for each test example.

TABLE 1

| Test Example # | Alloy Composition of Sample (wt %) | Treatment Temperature × Treatment Time | L* | a* | b* | Appearance |
|---|---|---|---|---|---|---|
| Test Example 1 | Al: Balance | Base Material | 76.35 | 1.11 | 7.18 | Silver |
| | Si: 0.3 | 40° C. × 60 s | 65.93 | 3.80 | 9.34 | Gray |
| | Mg: 4.5-5.6 | 40° C. × 120 s | 58.48 | 2.88 | 6.55 | Gray |
| | Cu: 0.1 | 40° C. × 150 s | 57.81 | 0.43 | 3.05 | Gray |
| | | 40° C. × 180 s | 59.64 | 0.34 | 3.61 | Gray |
| | | 50° C. × 60 s | 59.92 | 4.13 | 9.12 | Gray |
| | | 50° C. × 120 s | 60.38 | −0.11 | 4.79 | Gray |
| | | 50° C. × 150 s | 57.97 | 2.18 | 7.74 | Gray |
| | | 50° C. × 180 s | 53.72 | 5.06 | 4.81 | Gray |
| | | 60° C. × 60 s | 59.57 | 1.87 | 6.40 | Gray |
| | | 60° C. × 120 s | 54.88 | 1.98 | 6.66 | Gray |
| | | 60° C. × 150 s | 50.32 | 2.98 | 6.40 | Gray |
| | | 60° C. × 180 s | 53.04 | 2.04 | 7.28 | Gray |
| | | 70° C. × 60 s | 59.93 | 0.20 | 5.67 | Gray |
| | | 70° C. × 120 s | 49.13 | 4.24 | 7.72 | Gray |
| | | 70° C. × 150 s | 53.12 | 2.38 | 9.67 | Gray |
| | | 70° C. × 180 s | 45.46 | 4.48 | 7.70 | Gray |
| | | 80° C. × 60 s | 54.81 | 5.78 | 11.05 | Khaki |
| | | 80° C. × 120 s | 47.22 | 4.66 | 10.62 | Khaki |
| | | 80° C. × 150 s | 44.92 | 5.89 | 11.87 | Bronze |
| | | 80° C. × 180 s | 38.97 | 5.25 | 11.95 | Bronze |
| Test Example 2 | Al: Balance | 50° C. × 120 s | 60.73 | 1.81 | 4.23 | Gray |
| | Si: 0.4-0.8 | | | | | |
| | Mg: 0.8-1.2 | | | | | |
| | Cu: 0.05-0.4 | | | | | |
| Test Example 3 | Al: Balance | 50° C. × 120 s | 63.98 | 3.15 | 9.40 | Gray |
| | Si: 0.25 | | | | | |
| | Mg: 2.2-2.8 | | | | | |
| | Cu: 0.1 | | | | | |

[Evaluation Results]

It was confirmed that each of the samples of Test Examples 1 to 3 which were treated with the above metal surface treatment solution had a chemical conversion coating containing tellurium as a component element, and a colored coating could be formed on the surface of each sample. In addition, the Gray as used herein may also be expressed as antique silver.

For the samples of Test Example 1, the chemical conversion coatings obtained under the treatment conditions of 50° C.×120 seconds, 60° C.×120 seconds, and 80° C.×180 seconds were subjected to compositional analysis at arbitrary measurement points of 12 points, 6 points, and 8 points, indicating that the contents of tellurium were at least 83.7% by mass or more, 14.0% by mass or more, and 93.1% by mass or more, respectively. The balance is mainly aluminum and oxygen, and it may contain a minor amount of magnesium.

(Variation)

In Test Examples 1 to 3 as shown in Table 1, the slide fastener chain having elements after the final molding was immersed in the treatment solution, so that the entire element had visually the same color tone. By the way, when an alumite treatment is performed in the state of the deformed wire, an alumite coating will be formed only on the side surface of the deformed wire, so that the element made from the deformed wire has the alumite coatings on the legs, and no alumite coating is provided on the engaging head that is press-formed after the cutting. The alumite coating is colored by adsorbing a dye or a metal salt on a honeycomb-shaped porous coating formed by anodizing aluminum, and performing a pore-sealing treatment. The chemical conversion coating formed on the aluminum alloy fastening member according to an embodiment is characterized in that the chemical conversion coating is not formed on the alumite coating. Therefore, when the chemical conversion treatment was applied to the slide fastener chain having the elements formed from the deformed wire after the alumite treatment, a slide fastener chain was obtained which included elements in which the chemical conversion coating was not formed on the leg portion having the alumite coating, and the chemical conversion coating was formed on the engaging head portion having no alumite coating. In this case, the alumite coating and the chemical conversion coating having different colors can provide a slide fastener chain having an excellent design including elements having two-colored coatings.

DESCRIPTION OF REFERENCE NUMERALS

1 fastener tape
2 core portion
3 element
4 upper stopper
5 lower stopper
6 slider
10 slide fastener

The invention claimed is:

1. An aluminum alloy fastening member comprising:

a chemical conversion coating, the chemical conversion coating containing tellurium as a component element, wherein the chemical conversion coating of the aluminum alloy fastening member presents a gray color that satisfies color tone ranges of $-5 \leq a^* \leq 8$; $-3 \leq b^* \leq 10$; and $40 \leq L^* \leq 75$, in a CIELAB color space as defined in JIS Z 8781-4 (2013), and wherein the chemical conversion coating comprises 10% by mass or more of tellurium and/or a tellurium compound.

2. The aluminum alloy fastening member according to claim 1, wherein the chemical conversion coating has an average thickness of from 0.01 μm to 1.00 μm.

3. The aluminum alloy fastening member according to claim 1, wherein an aluminum alloy of the aluminum alloy fastening member has a composition represented by a general formula: $Al_aSi_bMG_c$, with each of a, b, and c being % by mass; symbol a being a balance; $0.1 \leq b \leq 1.5$; $0.2 \leq c \leq 5.6$; and which contains unavoidable impurities.

4. The aluminum alloy fastening member according to claim 1, wherein the aluminum alloy fastening member is an element for slide fasteners, a slider for slide fasteners, a stopper for slide fasteners, or a button.

5. A method for producing the aluminum alloy fastening member according to claim 1, the method comprising forming the chemical conversion coating containing tellurium as the component element by immersing the aluminum alloy fastening member in a metal surface treatment solution containing the tellurium or a tellurium compound or a salt thereof.

6. The method according to claim 5, wherein the tellurium or the tellurium compound or the salt thereof is tellurium monoxide, tellurium dioxide, tellurium trioxide, tellurous acid, telluric acid, tellurium tetrachloride, dimethyl telluride, or a salt thereof, or a combination thereof.

* * * * *